United States Patent [19]

Swift et al.

[11] 4,191,733

[45] Mar. 4, 1980

[54] REDUCTION OF CARBON MONOXIDE IN SUBSTOICHIOMETRIC COMBUSTION

[75] Inventors: Harold E. Swift, Gibsonia; Ajay M. Madgavkar, Pittsburgh; Roger F. Vogel, Butler, all of Pa.

[73] Assignee: Gulf Research and Development Company, Pittsburgh, Pa.

[21] Appl. No.: 921,329

[22] Filed: Jul. 3, 1978

[51] Int. Cl.[2] ..... B01D 53/34

[52] U.S. Cl. ..... 423/245; 423/247; 423/248

[58] Field of Search ..... 423/245, 219, 247, 248, 423/415 A, 213.2, 213.5, 245 S

[56] References Cited

U.S. PATENT DOCUMENTS

| | | | |
|---|---|---|---|
| 1,960,212 | 5/1934 | Walker | 423/219 |
| 3,480,384 | 11/1969 | Hardison | 423/219 |
| 4,009,242 | 2/1977 | Lauder et al. | 423/245 S |
| 4,025,606 | 5/1977 | Acres | 423/245 S |

*Primary Examiner*—Earl C. Thomas

[57] ABSTRACT

The combustible component of a gas stream of low heating value is combusted using less than a stoichiometric amount of oxygen with minor production of carbon monoxide in the presence of an oxygenation catalyst comprising platinum and a cocatalyst selected from Groups IIA and VIIB, Group VIII up through atomic No. 45, the lanthanides, chromium, zinc, silver, tin and antimony. This combusted gas can be directly vented to the atmosphere after energy has been extracted from it for a useful purpose.

22 Claims, No Drawings

REDUCTION OF CARBON MONOXIDE IN SUBSTOICHIOMETRIC COMBUSTION

SUMMARY OF THE INVENTION

This invention relates to the catalyzed combustion of combustible gases of low heat content.

We have discovered that the combustible component of a gas stream of low heating value can be combusted using less than a stoichiometric amount of oxygen with reduced production of carbon monoxide, if the platinum oxidation catalyst is associated with a cocatalyst selected from Groups IIA and VIIB, Group VIII up through atomic No. 45, the lanthanides, chromium, zinc, silver, tin and antimony.

DETAILED DESCRIPTION OF THE INVENTION

Hydrocarbon vapors or other gases of high heating value have for centuries been burned as a source of energy for heating purposes or as a source of motive power for driving machinery. Such combustion is carried out with sufficient air to accomplish complete combustion of the hydrocarbon gas to carbon dioxide and water.

In contrast, hydrocarbon-containing gas streams of low heating value, such as waste gas streams, have traditionally been discharged to the atmosphere. In recent years a greater recognition and concern about atmospheric pollution has led to legal standards controlling the direct emission to the atmosphere of waste gases containing significant amounts of hydrocarbons and/or carbon monoxide. In order to avoid atmospheric pollution, the hydrocarbon components in a waste gas stream of low heating value are generally combusted to carbon dioxide and water using an oxidation catalyst and a stoichiometric excess of oxygen for direct venting to the atmosphere. Examples of this procedure are numerous in the various manufacturing and industrial arts.

Recognizing the fact that a large amount of energy is contained in a large volume of low heating value gas, waste gas streams of low heating value are occasionally completely combusted and energy removed in a boiler or in a turbine before venting to the atmosphere. U.S. Pat. Nos. 2,449,096, 2,720,494 and 2,859,954 are examples of this latter concept of completely burning residual combustibles in a waste gas stream and recovering energy from the combusted gas stream before it is vented to the atmosphere. However, the arts do not appear to contemplate the intentional partial combustion of a waste gas stream of low heating value with energy recovery from the partially combusted gas stream prior to venting it to the atmosphere.

In order to oxidize the hydrocarbon portion in a diluted hydrocarbon stream, such as a mixture of methane and nitrogen, with a stoichiometric or excess amount of air, a suitable oxidation catalyst is required. A platinum-base catalyst is generally considered to be the most effective catalyst for this oxidation. The gas stream must be heated to its ignition, or light off, temperature, which is specific for each particular gas composition undergoing combustion, prior to contacting the gas stream with the catalyst. If the catalyst is provided in a suitable physical form to provide adequate contact of the gas with the catalyst, substantially complete combustion of the hydrocarbon to carbon dioxide and water is accomplished.

In contrast, combusting a stream of diluted hydrocarbon of low heating value in contact with a platinum oxidation catalyst and an insufficient, that is substoichiometric, amount of air cannot result in complete combustion of the hydrocarbon to carbon dioxide and water. Theoretically, such incomplete combustion could lead to a combination of some or all of the following chemical species: carbon dioxide, carbon monoxide, water, unreacted hydrocarbon, hydrogen, free carbon and partially oxidized hydrocarbon, such as methanol and formaldehyde in the case of methane, in addition to the nitrogen from the air. We have carried out such experiments on a hydrocarbon-containing gas stream of low heating value with a substoichiometric amount of oxygen and have not identified any significant amount of free carbon or any partially oxidized hydrocarbon in the product stream following such partial combustion. Therefore, according to our study the only combustibles present in this partially combusted gas stream are carbon monoxide, hydrogen and unreacted hydrocarbon.

In our study of this platinum-catalyzed, substoichiometric combustion of a dilute hydrocarbon stream we made several interesting observations. For example, we observed that in this partial combustion the amount of carbon monoxide reached a maximum at an air equivalence ratio of about 0.6 (the denominator of this ratio being 1.0 is not expressed). As used herein, air equivalence ratio, or A.E.R., is the ratio of the amount of air used in the partial combustion to the amount of air required at the same conditions of pressure and temperature for stoichiometric combustion of all combustible components in the gas stream. In fact, we found that the amount of carbon monoxide substantially exceeded the amount of carbon dioxide in the combusted gas at an A.E.R. of 0.6, such that the ratio of carbon dioxide to carbon monoxide was less than 1.0 at an A.E.R. between about 0.4 and about 0.7.

As would be expected in the platinum-catalyzed reaction, the molar ratio of carbon dioxide to carbon monoxide rapidly increased as the A.E.R. approached 1.0. But surprisingly we discovered that the molar ratio of carbon dioxide to carbon monoxide also rapidly increased as the A.E.R. was reduced to values less than about 0.4. This is surprising because it is not consistent with the conventional teaching that carbon monoxide is the result of incomplete combustion of a hydrocarbon. If this conventional teaching were applied to this particular combustion system, the ratio of carbon monoxide to carbon dioxide would be expected to increase as the air equivalence ratio decreased, and that it would be expected to be particularly large at small air equivalence ratios. We conclude from our combustion studies that the carbon monoxide in this platinum-catalyzed, substoichiometric combustion of a dilute hydrocarbon is primarily the result of secondary reactions including the steam reforming and water gas shift reactions.

In the steam reforming reaction, hydrocarbons such as methane and water are in equilibrium with carbon monoxide and hydrogen.

$$CH_4 + H_2O \rightleftharpoons CO + 3H_2 \quad (1)$$

In the water gas shift reaction carbon monoxide and water are in equilibrium with carbon dioxide and hydrogen.

$$CO + H_2O \rightleftharpoons CO_2 + H_2 \quad (2)$$

Thus, a study of these equilibrium reactions suggests several mechanisms for the unexpected product mixture of the oxides of carbon including the substantial production of carbon monoxide and a corresponding minimum in the carbon dioxide to carbon monoxide ratio at an air equivalence ratio of about 0.6.

We have surprisingly discovered that the course of the platinum catalyzed, substoichiometric combustion of a dilute hydrocarbon gas can be substantially affected by using certain metal cocatalysts in association with the platinum oxidation catalyst. Specifically, we have discovered that the amount of carbon monoxide can be substantially reduced in this substoichiometric combustion if a cocatalyst selected from Groups IIA and VIIB, Group VIII up through atomic No. 45, the lanthanides, chromium, zinc, silver, tin and antimony, and mixtures thereof is used with the platinum oxidation catalyst. Included in these groups and particularly useful as a catalyst are magnesium, calcium, manganese, iron, cobalt, nickel, ruthenium, rhodium, cerium and mixed lanthanides containing cerium.

The low heating value gas streams which can be substoichiometrically combusted by our novel method generally comprise one or more hydrocarbons diluted with a non-combustible gas. The hydrocarbon component can be a single hydrocarbon such as methane, or it can be a mixture of hydrocarbons having from one to about seven carbon atoms. Additionally, small amounts of non-hydrocarbon combustible gases can also be present including carbon monoxide, hydrogen sulfide and hydrogen. The non-combustible component will generally be nitrogen, carbon dioxide or mixtures of these two gases, and may frequently contain water vapor.

A mixture of diluted gaseous paraffinic hydrocarbons will react at different rates when burned in a deficiency of air. The higher paraffinic hydrocarbons burn readily while the lower the number of carbon atoms in the molecular structure the more resistant to combustion is the hydrocarbon. As a demonstration of this variable combustibility, a nitrogen-diluted two weight percent mixture of one to five carbon paraffinic hydrocarbons was burned in a combustion furnace with fifty percent of the stoichiometric amount of air for complete combustion. The gas, heated to 840° F. and passed in contact with a supported platinum oxidation catalyst, reached a maximum temperature of 1430° F. In this combustion experiment 100 percent of the n-pentane was converted, 54.5 percent of the n-butane, 44.1 percent of the propane, 31.8 percent of the ethane and 11 percent of the methane. This demonstrates that partial combustion of a gaseous hydrocarbon mixture including methane will substantially increase the proportion of methane in the product gas. This is fortuitous since methane is not regarded as an atmosphere pollutant. This benefit is particularly marked when methane is the primary combustible component of the waste gas stream.

Hydrogen sulfide will form sulfur dioxide as a combustion product which is itself controlled as a pollutant, therefore, its significant presence in the waste gas is undesired. The presence of hydrogen sulfide affects the catalyzed combustion reaction in several respects including a lowering in the overall conversion of hydrocarbons and an increase in the temperature required for the maintenance of continuous combustion. For these reasons, the amount of hydrogen sulfide in the waste gas stream undergoing substoichiometric combustion is desirably no more than about two weight percent and preferably a maximum of about 0.5 weight percent.

The waste gas stream can be the liquids-free flue gas obtained from subterranean in situ combustion processes for the recovery of hydrocarbons from carbonaceous deposits such as petroleum reservoirs, tar sands or oil shale formations. The hydrocarbon component in this flue gas, in general, will primarily be methane with decreasing amounts of the higher hydrocarbons up to about the six carbon hydrocarbons. Small amounts of carbon monoxide, hydrogen and hydrogen sulfide are expected constituents of this flue gas. The gas stream can also suitably be a hydrocarbon-containing factory waste gas stream resulting from solvent evaporation, incomplete combustion of a carbonaceous fuel, and the like. The waste gas stream can also be a low heating value producer gas stream containing hydrogen and carbon monoxide as its major combustibles.

As described, the combustion process of our invention relates to the catalyzed combustion of low heating value gas streams with insufficient oxygen for complete combustion. It is also possible and generally desirable to preheat the gas stream if it is of such low heating value that it will not support combustion at room temperature, that is at about 25° C., even in the presence of an oxidation catalyst. In this instance the preferred means of preheating the waste gas stream, either together with or in the absence of the air for combustion, is by heat exchange with the hot combusted gas stream. The combustion temperature, which determines the temperature in the combusted gas stream available for preheating, is dependent on a number of factors including the heating value of the gas stream undergoing combustion, the amount of air that is used for combustion and the temperature to which the feed gas stream is preheated. The temperature to which the gas is preheated is not critical other than it be sufficiently high to support combustion. The pressure present in the combustion zone also is not critical, varying from about atmospheric up to about 2,000 psi., more generally up to about 500 psi.

With these various conditions and variables in mind, the gas streams, which can be combusted to advantage by the herein-described catalytic procedure, will have a heating value of at least about 5, more preferably at least about 15 and most preferably at least about 30 Btu/scf. (one British thermal unit per standard cubic foot equals 9.25 kilocalories per cubic meter). And for similar reasons the maximum heating value of the gas stream undergoing combustion will be about 500, more desirably a maximum of about 350, and most desirably a maximum heating value of about 200 Btu/scf.

The platinum oxidation catalyst and metal cocatalyst that are used in our substoichiometric combustion process are carried on an inert support. Since the catalytic combustion inherently involves a relatively large volume of the stream of low heating value gas, the support is preferably of a design to permit good solid-gas contact at relatively low pressure drop. A suitable support can be formed as a monolith with hexagonal cells in a honeycomb design. Other cellular relatively open-celled designs are also suitable.

The support for the catalysts to be used in the process of this invention can be any of the refractory oxide supports well known in the art, such as those prepared from alumina, silica, magnesia, thoria, titania, zirconia, silica-aluminas, silica-zirconias, magnesia-aluminas, and the like. Other suitable supports include the naturally occurring clays, such as diatomaceous earth. Additional desirable supports for use herein are the more recently developed corrugated ceramic materials made, for example, from alumina, silica, magnesia, and the like. An example of such material is described in U.S. Pat. No. 3,225,027 and sold by E. I. duPont de Nemours & Company as Torvex. More recently, metallic monoliths have been fabricated as catalyst supports and these may be used to mount the catalytic material. An example of these supports is Fecralloy manufactured by Matthey Bishop, Inc. under U.S. Pat. Nos. 3,298,826 and 3,920,583.

If desired, the catalyst and cocatalyst materials can be mounted directly onto the surface of the monolith or the monolith can first be coated with a refractory oxide, such as defined above, prior to the deposition of these materials. The addition of the refractory oxide coating allows the catalyst materials to be more securely bound to the monolith and also aids in the dispersion of the catalytic materials. These coated monoliths possess the advantage of being easily formed in one piece of a suitable configuration to permit the passage of the combustion gases with little pressure drop. The surface area of the monolith generally is less than one square meter per gram. However, the coating generally has a surface area of between about ten and about 300 $m^2/g$. Since the coating is generally about ten percent of the coated support, the surface area of the coated support will therefore generally be between about one and about 30 $m^2/g$.

In preparing the catalyst it is preferred that the cocatalyst be placed on the support before the platinum. However, the reverse order of emplacement is also suitable or the platinum and cocatalyst can be added in a single step. In the preferred procedure a suitable salt of the cocatalyst metal is dissolved in a solvent, preferably water. The support is impregnated with the solution of the cocatalyst metal and in a preferred embodiment is next gassed with a suitable gas, generally ammonia or hydrogen sulfide, to cause the catalyst metal to precipitate uniformly on the support as the hydroxide or sulfide as the case may be. It is then dried and calcined in air at about 800° to 1200° F., preferably at about 1000° F. Hydrogen may be used to reduce the cocatalyst compound to the metal if desired.

The platinum is next impregnated onto the support as an aqueous solution of a suitable compound such as chloroplatinic acid, ammonium chloroplatinate, platinum tetramine dinitrate, and the like. The catalyst is then gassed with hydrogen sulfide in a preferred embodiment to cause precipitation of the platinum as the sulfide to ensure uniform distribution of the platinum on the support. It is again dried and then calcined in air at about 800° to 1200° F., preferably at about 1000° F.

When the cocatalyst hydroxide and/or hydrated sulfide is calcined, it is converted to the oxide form. However, when the cocatalyst sulfide or platinum sulfide is calcined in air, it is not certain how much of the metal sulfide is converted to another compound, such as the oxide, sulfite or sulfate, or to the metal. Nevertheless, the cocatalyst in the final product is reported as the oxide, and the platinum is reported as the metal.

The platinum and cocatalyst can also be added to the coated monolith as a slurry of finely ground powders. In the case of platinum, powdered metal is preferred but the platinum could also be added as the powdered oxide. The cocatalyst would preferably be added as the powdered oxide or sulfide. The powdered metals could be added together or in succession with calcining as described above. In a further alternative the coating material such as powdered alumina is impregnated with a solution of the metals and calcined. The monolith is then coated with a slurry of this powder and calcined. In this latter technique all of the catalyst components can be added to the monolith in one step.

The catalyst is prepared so that it contains between about 0.005 and about 20 weight percent of the cocatalyst reported as the oxide, and preferably between about 0.1 and about 15 weight percent of the metal oxide. The platinum is introduced in an amount to form a finished catalyst containing between about 0.005 and about ten weight percent platinum reported as the metal, and preferably about between 0.01 and about seven weight percent platinum. We have also determined that the relative amount of the cocatalyst and the platinum has an effect on the combustion, including an effect in the amount of carbon monoxide in the combusted gas. The catalyst will broadly contain a mol ratio of cocatalyst as the oxide to platinum as the metal of between about 0.01:1 and about 200:1, preferably between about 0.1:1 and about 100:1, and most preferably between about 0.5:1 and about 50:1.

The gas stream of low heating value, such as a waste gas stream, can contain up to about fifty mol percent of one or more hydrocarbons having from one to about seven carbon atoms. But as indicated the gas stream can also contain other combustibles including up to about fifteen mol percent carbon monoxide and up to about ten mol percent hydrogen. Although the combustible component of the low heating value gas stream will generally contain at least about fifty mol percent of the aliphatic hydrocarbons and frequently at least about ninety mol percent of these aliphatic hydrocarbons, it can also be free of these hydrocarbons, such as a dilute producer gas containing only hydrogen and carbon monoxide. In the substoichiometric combustion of these various low heating value gas streams, the air equivalence ratio will be less than 1.0, but generally it will be between about 0.2 and about 0.9 and preferably between about 0.35 and about 0.75.

DESCRIPTION OF PREFERRED EMBODIMENTS

EXAMPLE 1

The preparation of a catalyst containing antimony as the cocatalyst is now described. A Torvex monolith was used as the support. The Torvex support, a product of E. I. duPont de Nemours and Co. was a mullite ceramic in the shape of a honeycomb having a coating of alumina of about 25 $m^2/g$. surface area. The support was cut into one inch diameter by one inch deep pieces and freed from dust. This support material was impregnated with a solution containing 15.96 g. of antimony trichloride in 44.04 g. of a 1:3 solution of HCl and water by soaking for 15 minutes. These pieces of support were drained of excess solution and treated with gaseous ammonia for 30 minutes to precipitate the antimony as the hydroxide. The support material was then dried at 120° C. and calcined at 1000° F.

The pieces were next soaked for 15 minutes in an aqueous solution of chloroplatinic acid containing 23 mg. of platinum per ml. After removing excess solution from the support material, it was gassed with hydrogen sulfide for 30 minutes to precipitate the platinum as platinum sulfide. The catalyst was then dried at 120° C. and calcined at 1000° F.

Other catalysts were prepared in an identical manner except that where necessary the cocatalyst was precipitated with hydrogen sulfide instead of with ammonia such as a catalyst prepared by impregnating the support with an aqueous solution of nickel nitrate.

The reactor used in the following experiments was a one-inch I. D. forged steel unit which was heavily insulated to give adiabatic reaction conditions. The catalyst consisted of three one-inch monoliths wrapped in a thin sheet of a refractory material (Fiberfrax, available from Carborundum Co.). Well insulated preheaters were used to heat the gas stream before it was introduced into the reactor. The temperature was measured directly before and after the catalyst bed to provide the inlet and outlet temperatures. An appropriate flow of preheated nitrogen and air was passed over the catalyst until the desired feed temperature was obtained.

Preheated hydrocarbon was then introduced at a gas hourly space velocity of 42,000 per hour on an air-free basis and combustion was allowed to proceed until steady state conditions were reached. The feed gas stream contained 94.5 mol percent nitrogen, 3.75 mol percent methane, 0.98 mol percent ethane, 0.77 mol percent propane and 400 ppm. hydrogen sulfide, except where otherwise noted. The heating value of this feed stream is about 75 Btu/scf. The experiments were conducted at atmospheric pressure or at a slightly elevated pressure, except where otherwise noted. The analyses were made after steady state conditions were reached on a water-free basis. The conversion is the overall conversion of all hydrocarbon constituents. No measurable free oxygen occurred in the product gas stream.

EXAMPLE 2

A catalyst was made as described in Example 1 containing about 0.3 percent platinum but the cocatalyst was omitted for comparison purposes. The operating data and results over a series of air equivalence ratios are set out in Table I:

Table I

| Run | AER | Temperature °F. In-let | Temperature °F. Out-let | CO Mol % | $CO_2$ Mol % | $CO_2$/CO | $CO_2$ + CO Mol % | Conv. % |
|---|---|---|---|---|---|---|---|---|
| 1[a] | 0.2 | 700 | 943 | 0.14 | 1.28 | 9.6 | 1.42 | 19.3 |
| 2 | 0.3 | 650 | 1062 | 0.45 | 1.66 | 3.69 | 2.11 | 23.3 |
| 3 | 0.4 | 650 | 1148 | 1.17 | 1.69 | 1.44 | 2.61 | 42.1 |
| 4[a] | 0.5 | 650 | 1236 | 1.94 | 1.66 | .86 | 3.59 | 57.3 |
| 5 | 0.6 | 650 | 1315 | 2.42 | 1.79 | .74 | 4.21 | 71.4 |
| 6[a] | 0.7 | 650 | 1415 | 2.11 | 2.43 | 1.17 | 4.54 | 81.5 |
| 7 | 0.8 | 650 | 1596 | 0.75 | 4.03 | 5.37 | 4.78 | — |

[a]Average of 2 runs on different days.

A study of Table I discloses that over a wide range of air equivalence ratios the amount of carbon dioxide remains relatively constant between an A.E.R. of about 0.3 to about 0.6 while the amount of carbon monoxide rapidly increases in this range to an unexpected peak at an A.E.R. of about 0.6. Over this range of increasing oxygen, the conversion and overall amount of carbon oxides increase, as would be expected. It is further noted that the largest carbon dioxide to carbon monoxide ratio surprisingly occurs at minimum oxygen, such as illustrated at an A.E.R. of 0.2, since the production of carbon dioxide unexpectedly decreases much more than the production of carbon monoxide as the amount of oxygen decreases in the low range of air equivalence ratios.

That the maximum carbon dioxide to carbon monoxide ratio occurs at minimum oxygen strongly suggests to us that the principal source of carbon monoxide in the system is not from incomplete combustion, that is, the direct but partial oxidation of the hydrocarbon to carbon monoxide and water. If this reaction were the principal source of the carbon monoxide, then the minimum carbon dioxide to carbon monoxide ratio would be expected to occur at minimum oxygen. Instead, the surprising occurrence of maximum carbon monoxide and minimum carbon dioxide ratio in the mid A.E.R. range, strongly suggests that another mechanism is the primary source of the carbon monoxide, such as the steam reforming reaction and the water gas shift reaction.

EXAMPLE 3

A catalyst was made as described in Example 1 containing tin calculated as about 1.0 percent tin oxide, $SnO_2$, and about 0.3 percent platinum. The operating data and results over a series of air equivalence ratios are set out in Table II.

Table II

| Run | AER | Temperature °F. In-let | Temperature °F. Out-let | CO Mol % | $CO_2$ Mol % | $CO_2$/CO | $CO_2$ + CO Mol % | Conv. % |
|---|---|---|---|---|---|---|---|---|
| 8 | 0.2 | 745 | 1069 | 0.06 | 1.35 | 22.5 | 1.41 | 19.9 |
| 9 | 0.3 | 649 | 1170 | 0.14 | 1.89 | 13.5 | 2.03 | 27.8 |
| 10 | 0.4 | 649 | 1297 | 0.37 | 2.19 | 5.92 | 2.56 | 37.5 |
| 11 | 0.5 | 649 | 1413 | 0.63 | 2.49 | 3.95 | 3.12 | 44.8 |
| 12 | 0.6 | 649 | 1519 | 0.79 | 2.79 | 3.53 | 3.58 | 56.2 |
| 13[a] | 0.7 | 649 | 1619 | 1.08 | 3.12 | 2.90 | 4.20 | 70.5 |
| 14[a] | 0.8 | 650 | 1786 | 0.86 | 3.86 | 4.52 | 4.72 | 91.3 |

[a]Average of two runs on different days.

A comparison of the data in Table II, in which a cocatalyst of tin is present, with the data in Table I, which was carried out using platinum without a cocatalyst, provides some valuable insights. In particular, it is noted that the amount of carbon monoxide is less in Table II than in Table I at all air equivalence ratios up to 0.8 and that correspondingly the amount of carbon dioxide and the carbon dioxide to carbon monoxide ratio is substantially greater over this range. Of special significance is the substantial decrease in carbon monoxide resulting from the use of the cocatalyst with the maximum decrease from 2.42 mol percent to 0.79 mol percent occurring at an A.E.R. of 0.6, a 67 percent decrease. It is further noted in Table II that the maximum carbon monoxide occurs at an A.E.R. of 0.7 while in Table I the maximum carbon monoxide occurs at an A.E.R. of 0.6.

Comparison of Examples II and III reveals that there is complete combustion, that is complete utilization of the oxygen, with no difference in the rate of combustion. This indicates that the cocatalyst does not function as a promoter for the platinum oxidation catalyst. Instead, the primary function of the cocatalyst is the suppression of carbon monoxide which apparently is the result of a catalytic influence on the reactions which produce carbon monoxide, such as the steam reforming reaction and the reverse water gas shift reaction.

EXAMPLE 4

A supported composite containing 1.5 percent tin oxide was made by the method described in Example 1, but platinum was intentionally omitted to test the effectiveness of tin oxide as an oxidation catalyst. The low heating value gas stream and air at an air equivalence ratio of 0.7 were heated to a temperature of 784° F. and passed over this supported tin oxide composite. No combustion was obtained.

EXAMPLE 5

A series of catalysts were prepared by the method described in Example 1. Many of these catalysts were tested at different air equivalence ratios and it was found that the maximum carbon monoxide occurred at an A.E.R. of about 0.7 when a cocatalyst was used, confirming the data of Table II. This contrasts with Table I which shows maximum carbon monoxide occurring at an A.E.R. of 0.6 when no cocatalyst is used with platinum.

Table III summarizes a series of many experiments by setting forth the results of various catalytic combinations at an A.E.R. of 0.7 for the two-component catalysts, except as noted, and an A.E.R. of 0.6 for the platinum-only catalysts. All runs were carried out at an inlet temperature of 649°-650° F.The catalysts contained approximately 0.3 weight percent platinum, or approximately 0.5 weight percent where specially noted. The approximate amount of the cocatalyst component is also given in weight percent based on the entire catalyst including the support. The specified catalyst compositions are only approximate because they are based on the composition of the impregnating solution and the amount absorbed and are not based on a complete chemical analysis of the finished catalyst. In Table III palladium and ruthenium were calculated as the metal while in Run 31 the cocatalyst was prepared from stannous chloride rather than stannic chloride as in the other examples using tin.

The data in Table III is listed in order of decreasing carbon monoxide content in the product gas.

Table III

| Run | Cocatalyst | Outlet °F. | CO mol % | $CO_2$ mol % | Conv. % |
|---|---|---|---|---|---|
| 15[a] | — | 1285 | 2.85 | 1.59 | 76.3 |
| 16 | 1% $WO_3$ | 1576 | 2.56 | 1.87 | 81.0 |
| 5 | — | 1315 | 2.42 | 1.79 | 71.4 |
| 17 | 0.5% $TiO_2$ | 1584 | 2.40 | 2.21 | 84.6 |
| 18 | 1% CdO | 1607 | 2.25 | 2.21 | 80.4 |
| 19 | 0.56$ZrO_2$ | 1579 | 2.22 | 2.41 | 77.8 |
| 20 | 1% $MoO_3$ | 1591 | 2.18 | 2.21 | 77.6 |
| 21[b] | 0.7% Pd | 1472 | 1.77 | 2.05 | 63.3 |
| 22 | 1% ZnO | 1572 | 1.74 | 2.62 | 75.3 |
| 23 | 0.5% Ru | 1597 | 1.64 | 2.69 | 74.2 |
| 24[a] | 0.5% $SnO_2$ | 1611 | 1.55 | 3.08 | 78.3 |
| 25 | 1.2% $Mn_2O_3$ | 1632 | 1.52 | 2.73 | 73.0 |
| 26 | 1% $Ce_2O_3$ | 1576 | 1.41 | 2.74 | 77.4 |
| 27[b] | 0.7% $Cr_2O_3$ | 1515 | 1.33 | 2.57 | 63.0 |
| 28[a] | 1.25% $SnO_2$ | 1609 | 1.28 | 3.20 | 76.5 |
| 29[c] | 0.7% $Fe_2O_3$ | 1599 | 1.15 | 3.00 | 70.5 |
| 30[c] | 0.5% $SnO_2$ | 1607 | 1.12 | 3.18 | 72.4 |
| 13[c] | 1% $SnO_2$ | 1619 | 1.08 | 3.12 | 70.5 |
| 31[c] | 1.25$SnO_2$ | 1638 | 1.00 | 3.27 | 70.6 |
| 32[c] | 1.5% $SnO_2$ | 1637 | 0.85 | 3.26 | 71.4 |
| 33 | 1% CoO | 1625 | 0.85 | 3.09 | 72.0 |
| 34 | 1% CaO | 1642 | 0.83 | 2.96 | 67.6 |
| 35 | 4.5% $SnO_2$ | 1633 | 0.81 | 3.33 | 72.7 |
| 36[c] | 3% $SnO_2$ | 1616 | 0.68 | 3.32 | 69.2 |
| 37 | 1% NiO | 1652 | 0.48 | 3.34 | 68.2 |

Table III-continued

| Run | Cocatalyst | Outlet °F. | CO mol % | $CO_2$ mol % | Conv. % |
|---|---|---|---|---|---|
| 38 | 1% $Sb_2O_3$ | 1684 | 0.46 | 3.40 | 65.8 |

[a]0.5% platinum.
[b]A.E.R.= 0.6.
[c]Average of two runs on different dates.

EXAMPLE 6

Data for a further series of bimetallic catalysts that were unsuccessfully tested at an air equivalence ratio of 0.7 are set out in Table IV. All of the catalysts contained approximately 0.3 weight percent platinum except where indicated otherwise.

Table IV

| Run | Cocatalyst | Pt | Inlet Temp. °F. | Conv. % |
|---|---|---|---|---|
| 39[a] | CuO | 0.3% | 770 | — |
| 40[a] | 1% $Bi_2O_3$ | 0.3% | 770 | — |
| 41[a] | 1% $V_2O_5$ | 0.3% | 732 | — |
| 42[a] | 0.3% CuO + 0.3% $Cr_2O_3$ | 0.3% | 750 | — |
| 43[b] | 0.3% CuO + 0.3% $Cr_2O_3$ | none | 650 | — |
| 44[b] | 1% PbO | 0.3% | 649 | — |

[a]Unstable combustion, steady state combustion never reached.
[b]No combustion.

The data in this table show that some metals that are known to be effective oxidation catalysts are not effective as cocatalysts in the present catalyst. For example, copper oxide, vanadium oxide, lead oxide and copper chromite are recognized as oxidation catalysts. In contrast, tin oxide which is shown in Tables II and III to be an effective suppressor of carbon monoxide with a platinum oxidation catalyst in substoichiometric combustion, is not effective as an oxidation catalyst as shown in Example 4.

EXAMPLE 7

Data from a series of runs are set out in Table V to illustrate the effect on carbon monoxide output of variations in the relative amount of cocatalyst and platinum using tin oxide as the cocatalyst. These runs were carried out at an air equivalence ratio of 0.7. All catalysts had been prepared from stannic chloride except the catalyst in Run 31 which was prepared from stannous chloride. A number of these runs, marked A and B, were duplicates carried out on different dates.

Table V

| Run | $SnO_2$ Wt. % | Pt Wt. % | $SnO_2$/Pt | CO mol % | $CO_2$ mol % |
|---|---|---|---|---|---|
| 24 | 0.5 | 0.5 | 1.0 | 1.55 | 3.08 |
| 30A | 0.5 | 0.3 | 1.67 | .98 | 3.31 |
| 30B | 0.5 | 0.3 | 1.67 | 1.25 | 3.04 |
| 28 | 1.25 | 0.5 | 2.5 | 1.28 | 3.20 |
| 13A | 1.0 | 0.3 | 3.33 | 1.06 | 3.14 |
| 13B | 1.0 | 0.3 | 3.33 | 1.09 | 3.10 |
| 31A | 1.25 | 0.3 | 4.17 | 1.05 | 3.19 |
| 31B | 1.25 | 0.3 | 4.17 | 0.95 | 3.34 |
| 32A | 1.5 | 0.3 | 5.0 | 0.80 | 3.41 |
| 32B | 1.5 | 0.3 | 5.0 | 0.89 | 3.11 |
| 36A | 3.0 | 0.3 | 10.0 | 0.70 | 3.33 |
| 36B | 3.0 | 0.3 | 10.0 | 0.66 | 3.30 |
| 35 | 4.5 | 0.3 | 15.0 | 0.81 | 3.33 |

EXAMPLE 8

Several of the bimetallic catalysts which resulted in the greatest reduction in the production of carbon monoxide as set forth in Table III were tested to determine the minimum temperature to which a feed gas stream must be heated to maintain continuous combustion. This temperature is designated the light off temperature (L.O.T.). The same feed gas stream as used in the preceding runs was also used. The space velocity was 42,000/hr. on an air free basis and the air equivalence ratio was 0.7. The pressure was atmospheric or slightly above atmospheric. The various light off temperatures and the carbon monoxide produced under the specific conditions of these runs are set out in Table VI after relatively steady state operation was apparently reached. The five bimetallic catalysts, all containing about 0.3 weight percent platinum, are compared with an unmodified catalyst containing about 0.3 weight percent platinum.

Table VI

| Run | Catalyst | L.O.T., °F. | CO mol % |
|---|---|---|---|
| 45 | 0.3% Pt | 515 | 1.50 |
| 46 | 1% CoO | 535 | 0.72 |
| 47 | 1% $Sb_2O_3$ | 560 | 0.39 |
| 48 | 1% $SnO_2$ | 590 | 0.86 |
| 49 | 1% NiO | 615 | 0.78 |
| 50 | 1% CaO | 650 | 0.83 |

Since the light off temperature is an indicator of the relative oxidation activity of a catalyst, the lower the light off temperature the more active the catalyst, this data indicate that the cocatalyst does not promote the oxidation activity of the platinum.

These multimetallic catalysts can be effectively used to significantly reduce carbon monoxide emissions in the substoichiometric combustion of a variety of waste gas streams of relatively low heating value. The choice of the particular cocatalyst to be used with the platinum oxidation catalyst can depend on a number of factors such as the desired minimum combustion temperature, the maximum desired carbon monoxide level, the composition of the waste gas stream, the sensitivity of the catalyst to poisoning if sulfur or other catalyst poisons are present in the feed gas stream, the life of the catalyst under the conditions of operation, and the like.

The waste gas stream combusted with this multimetallic catalyst can be used as a source of heat for operating a boiler and the like, but a particularly suitable use is a source of motive power for driving a gas turbine. In this latter use, the combustion is carried out at an elevated pressure of about 75 psi. or higher so that the combusted gas stream can expand in the turbine. The waste gas stream that is combusted with the platinum and cocatalyst combination, can then be vented to the atmosphere at greatly reduced carbon monoxide levels in contrast with the use of a simple platinum oxidation catalyst.

The minimum combustion temperature of the waste gas stream can be maintained by preheating the waste gas stream prior to combustion, desirably by passing it in heat exchange with the hot combusted gas stream. If the heating value of the stream of waste gas varies with time, the temperature at the point of use, such as a gas turbine, is maintained at a constant operating level by feeding a substoichiometric but constant stream of air to the gas stream prior to its introduction into the combustion zone.

The substoichiometric combustion can be carried out in one or more combustion zones. If more than one combustion zone is utilized, such as would be involved in a series of two or more combustion chambers, each combustion zone will contain its own oxidation catalyst. In this multi-zone combustion, the multimetallic catalyst as described herein, can be used on one combustion zone, and a conventional oxidation catalyst, such as a platinum oxidation catalyst, can be used in the other combustion zone or zones. Alternatively, the multimetallic catalyst can be used in every combustion zone in a multizone combustion procedure. When multicombustion zone operation is utilized, the amount of air required for overall substoichiometric operation is approximately equally divided and introduced into each combustion zone. For example, when two combustion zones are used, a maximum of two-thirds and preferably fifty percent of the total combustion air is introduced into one combustion zone.

It is to be understood that the above disclosure is by way of specific example and that numerous modifications and variations are available to those of ordinary skill in the art without departing from the true spirit and scope of the invention.

We claim:

1. A method for the partial combustion of a low heating value gas stream with reduced carbon monoxide production for venting to the atmosphere, said gas stream having an average heating value in the range of about 5 to about 500 Btu/scf. and comprising a combustible component selected from one or more aliphatic hydrocarbons having from one to about seven carbon atoms and carbon monoxide and containing up to about 50 mol percent of one or more of said aliphatic hydrocarbons, up to about 15 mol percent carbon monoxide and up to about 10 mol percent hydrogen as the major combustible components which comprises the steps passing said gas stream admixed with air for combustion at an average air equivalence ratio of between about 0.2 and about 0.9 in contact with a supported platinum oxidation catalyst having incorporated therewith at least one metal cocatalyst selected from Groups IIA and VIIB, Group VIII up through atomic No. 45, the lanthanides, chromium, zinc, silver, tin and antimony in at least one combustion zone at a temperature high enough to initiate and maintain combustion of said gas stream, and venting said partially combusted gas stream to the atmosphere.

2. A method for the partial combustion of a gas stream in accordance with claim 1 in which the said aliphatic hydrocarbons comprise at least about 50 mol percent of the combustible components.

3. A method for the partial combustion of a gas stream in accordance with claim 2 in which the cocatalyst is antimony.

4. A method for the partial combustion of a gas stream in accordance with claim 2 in which the cocatalyst is nickel.

5. A method for the partial combustion of a gas stream in accordance with claim 2 in which the cocatalyst is calcium.

6. A method for the partial combustion of a gas stream in accordance with claim 2 in which the cocatalyst is cobalt.

7. A method for the partial combustion of a gas stream in accordance with claim 2 in which the cocatalyst is tin.

8. A method for the partial combustion of a gas stream in accordance with claim 2 in which methane comprises at least about 50 mol percent of the hydrocarbon component of the gas stream.

9. A method for the partial combustion of a gas stream in accordance with claim 1 in which the gas stream contains up to about two weight percent hydrogen sulfide.

10. A method for the partial combustion of a gas stream in accordance with claim 2 in which the aliphatic hydrocarbons comprise at least about 90 mol percent of the combustible component and the air equivalence ratio is between about 0.35 and about 0.75.

11. A method for the partial combustion of a gas stream in accordance with claim 1 in which the catalyst contains between about 0.005 and about ten weight percent platinum and between about 0.005 and about twenty weight percent of said cocatalyst and the mol ratio of said cocatalyst as the oxide to the platinum as the metal in said catalyst is from about 0.01:1 to about 200:1.

12. A method for the partial combustion of a gas stream in accordance with claim 2 in which the catalyst contains between about 0.01 and about seven weight percent platinum and between about 0.01 and about fifteen weight percent of said cocatalyst and the mol ratio of said cocatalyst as the oxide to said platinum as the metal in said catalyst is between about 0.1:1 and about 100:1.

13. A method for the partial combustion of a gas stream in accordance with claim 12 in which the mol ratio of said cocatalyst as the oxide to said platinum as the metal is between about 0.5:1 and about 50:1.

14. A method for the partial combustion of a gas stream in accordance with claim 2 in which the average heating value of said gas stream is between about 15 Btu/scf. and about 350 Btu/scf.

15. A method for the partial combustion of a gas stream in accordance with claim 2 in which the air is added for combustion at a substantially constant rate with time.

16. A method for the partial combustion of a gas stream in accordance with claim 15 in which the heating value of the gas stream varies with time.

17. A method for the partial combustion of a gas stream in accordance with claim 16 in which the air feed rate will not result in a stoichiometric excess of oxygen over a substantial period of time.

18. A method for the partial combustion of a gas stream in accordance with claim 2 in which the average heating value of said gas stream is between about 30 and about 200 Btu/scf.

19. A method for the partial combustion of a gas stream in accordance with claim 1 in which the said gas stream and a portion of the air required for partial combustion is passed in contact with each of two oxidation catalysts in series with at least the first catalyst being the said platinum and cocatalyst combination.

20. A method for the partial combustion of a gas stream in accordance with claim 19 in which both of said oxidation catalysts are identical.

21. A method for the partial combustion of a gas stream in accordance with claim 19 in which a maximum of two-thirds of said combustion air is added to the gas stream prior to combustion in either stage.

22. A method for the partial combustion of a gas stream in accordance with claim 21 in which about fifty percent of said combustion air is added to each stage.

* * * * *